US005542865A

United States Patent [19]

Alvarez De Toledo

[11] Patent Number: 5,542,865

[45] Date of Patent: Aug. 6, 1996

[54] TRIPLE-MATERIAL FIN WITH COMPOSITE BLADE

[75] Inventor: Marc Alvarez De Toledo, Marseille, France

[73] Assignee: Alba Conseil, Marseille, France

[21] Appl. No.: 245,691

[22] Filed: May 18, 1994

[30] Foreign Application Priority Data

May 25, 1993 [FR] France ..... 9306211

[51] Int. Cl.[6] ..... A63B 31/08

[52] U.S. Cl. ..... 441/64

[58] Field of Search ..... 441/61, 64, 55, 441/60; 264/250, 251, 255; 156/304.1, 304.5

[56] References Cited

U.S. PATENT DOCUMENTS 4,544,588 10/1985 Schauf ..... 156/304.5
4,887,985 12/1989 Garofalo ..... 441/64
4,954,112 9/1990 Negrini et al. ..... 441/64
5,304,081 4/1994 Takizawa ..... 441/64
5,358,439 10/1994 Paolo ..... 441/64

FOREIGN PATENT DOCUMENTS 0579046 1/1994 European Pat. Off. ..... 441/64

*Primary Examiner*—Sherman Basinger
*Attorney, Agent, or Firm*—Malin, Haley, DiMaggio & Crosby, P.A.

[57] ABSTRACT

The present invention relates to a swimming fin comprising a shoe (1) prolonged by a blade, the blade of which is constituted by the assembly of at least one flexible blade element (2) and at least one stiffening blade element (3) which are arranged edge to edge and are rendered integral by the overmolding of an appropriate bonding material (4) over the adjacent edges. The present invention also relates to a method of manufacturing composite fins.

19 Claims, 3 Drawing Sheets

TRIPLE-MATERIAL FIN WITH COMPOSITE BLADE

BACKGROUND OF THE INVENTION

1. Field of the Invention

The present invention relates to a swimming fin and its method of manufacture.

2. Description of the Prior Art

Swimming fins have to meet several technical and commercial criteria which may be defined in terms of performance, comfort, lightness and esthetics.

State of the art solutions have principally taken into account the problems of performance and comfort.

The performance of a fin is related to the surface area and to the nerviness or stiffness of its blade.

In order to obtain a nervy or stiff blade, it is necessary either to employ a rigid material, such as a composite material based on glass fiber, or else to employ a material of the synthetic polymer resin type which will be stiffened by longitudinal ribs.

However, a rigid blade is generally somewhat incompatible with a comfortable shoe, more particularly for the fins called "snug-fitting" fins where it is necessary to deform the shoe in order to insert the user's foot.

It has therefore been proposed to employ two materials, one a rigid one for the blade and the other a flexible one for the shoe and the state of the art proposes various means capable of solving the problem of good flexible-shoe rigid-blade energy transfer.

Thus, Patent Application EP-A-O,380,333 proposes a fin where the "shoe" is reduced to its simplest expression since it comprises straps crossed over the user's foot.

More generally, the fin is produced by molding the shoe onto the blade. However, it is necessary that the material employed for the shoe to be sufficiently flexible in order to absorb the deformations of the blade in finning action, without giving rise to mechanical tearing.

A first solution, described especially in Patent Applications FR-A-2,173,504 and FR-A-2,213,072, consists in mechanically anchoring the shoe in the blade.

A second solution consists in employing, for the blade and the shoe, chemically compatible materials so as to ensure good cohesion by molding of the shoe, In this case, an ethylene/vinyl acetate (EVA) copolymer will generally be employed for the blade and a thermoplastic polymer, principally polypropylene-based, "elastomer" for the shoe.

It is also possible to employ, for the blade and for the shoe, polyurethane-based polymers, although it is difficult to obtain a polyurethane sufficiently flexible for the production of "snug-fitting" fins.

Although twin-material fins of the EVA/"elastomer" type are satisfactory in terms of performance and comfort, as in terms of cost price (approximately 4 times less than for fins made of polyurethane), they do not enable the problems of lightness and esthetics to be taken into account.

Lightness becomes a problem to take into consideration when it is desired to produce large-sized blades. In order to maintain good performance, it is then necessary to increase the thickness of the ribs ensuring the nerviness and, possibly, the number of them, thereby leading not only to an increase in the weight, but also an increase in the manufacturing time for the blade.

Finally, the esthetics of the fin become a technical problem when the color or shiny effect or the design which are desired are related to the material employed, it being possible for the latter to be prejudicial to the performance or to the lightness of the fin.

Thus, it is not possible to produce a shiny blade made of EVA, unless it is employed as a mixture with vinyl, thereby leading to a drop in performance requiring a significant increase in thickness of the ribs, and therefore in the weight of the fin and its manufacturing time.

SUMMARY OF THE INVENTION

The present invention therefore relates to a swimming fin which has a good performance, is comfortable and lightweight, and also ensures freedom of choice in the materials employed, permitting great design flexibility, both as regards shape, absence of ribs or fine ribs, and as regards color or shininess.

The fin according to the invention comprises a shoe prolonged by a blade, which is constituted by the assembly of at least one flexible blade element and at least one stiffening blade element which are arranged edge to edge and rendered integral by the overmolding of an appropriate bonding material over the adjacent edges.

By overmolding is meant, for the present invention, any supply of appropriate bonding material deposited at the junction of the elements which have to be rendered integral for the production of the blade, and ensuring their cohesion.

Thus, generally, the bonding material may be deposited at the junction of the elements to be rendered integral so as partially to cover each blade element in the proximity of their adjacent edge.

However, when one of the elements is thicker than the adjacent element to which it is to be bonded, and when a difference in level therefore exists between the two elements, their cohesion may be ensured by depositing the bonding material at the junction of the two edges, partially covering the thinner element in the proximity of the adjacent edge, over a thickness substantially equal to the difference in level of the two elements, so that the bonding material is contained in the prolongation of the thicker element.

It is possible to envisage additional means for mechanically anchoring the bonding material onto the blade elements.

However, this solution is not absolutely necessary when, for the flexible blade element, for the stiffening blade element and for the bonding material, a polymer material is employed of the same chemical base, but having, for each of them, physical characteristics, in terms of density and elasticity, which are specific to their respective functions, the cohesion of the various elements then being ensured by the good adhesive properties of the bonding material.

Preferentially, the blade elements are assembled by their longitudinal edges, which are oriented substantially in the direction of the length of the fin.

The blade elements will have an adapted shape so that their edge-to-edge arrangement, in the manner of a "jigsaw puzzle", adopts the shape and dimensions appropriate for a fin blade.

They therefore preferably have a flat shape with an average thickness lying between 0.3 and 1 cm, the elements arranged in the proximity of the shoe being able to be thicker than those at the end of the blade.

Likewise, the elements arranged in the direction of the length of the fin may have various thicknesses at their ends, the end close to the shoe being the thickest.

For reasons of esthetics or of controlling the flow of the streams, they may, if required, comprise ribs oriented in the direction of the length of the fin.

According to a preferential embodiment of the invention, the blade elements are arranged side by side.

According to another preferential embodiment, they are fitted into each other, before being rendered integral by the overmolding.

In this case, the blade elements are not connected, rigidly fixed to each other, their cohesion being ensured by the single overmolding of the bonding material.

Advantageously, the flexible blade element is made of EVA.

For its part, the stiffening element preferably consists of a thermoplastic "elastomer" material.

Finally, the appropriate bonding material is advantageously a thermoplastic material, preferably a polypropylene-based one.

Preferentially, the fin according to the invention comprises a flexible element made of EVA, possibly with vinyl added, a stiffening element made of polypropylene and a bonding material made of a polypropylene-based thermoplastic "elastomer".

According to another preferential embodiment of the invention, the three blade elements are polypropylene-based.

Finally, the appropriate bonding material and the shoe advantageously consist of the same material.

Other characteristics of the fin according to the invention are illustrated by the appended FIG. 1.

DETAILED DESCRIPTION OF THE PREFERRED EMBODIMENT

Figure 1:
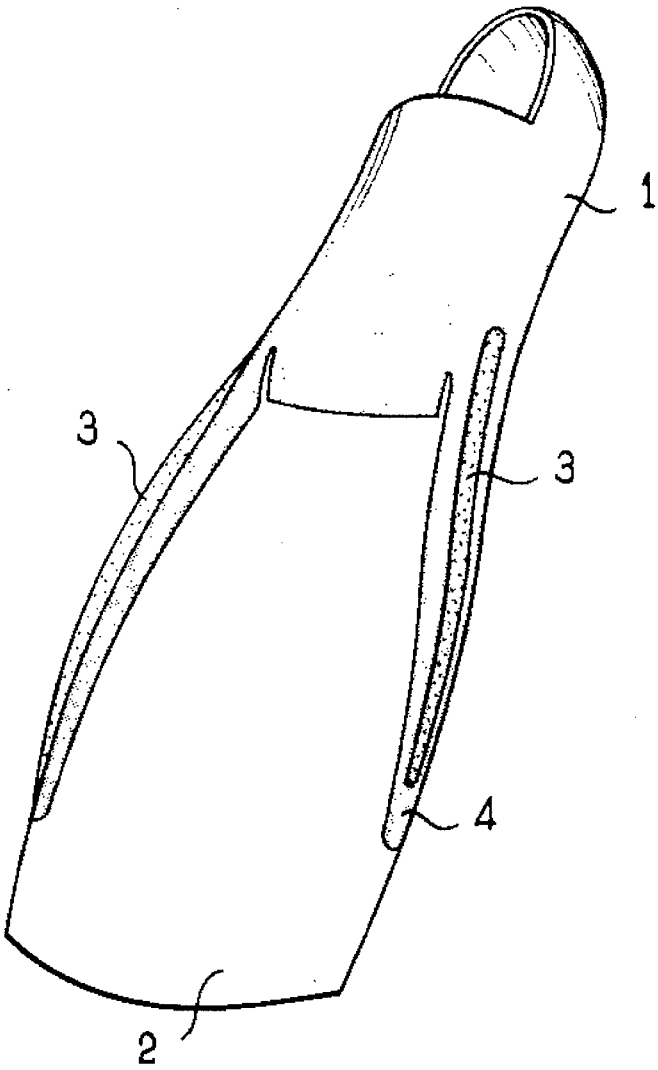
FIG. 1 is a perspective view of the present invention incorporating a snug-fitting shoe portion.

FIG. 1 represents a fin of the snug-fitting type, comprising a shoe (1), a central flexible blade element (2) flanked by two stiffening blade elements (3), which are rendered integral by the overmolding of the bonding material (4).

The flexible blade element (2) represents more than 60% of the total surface area of the blade, once the elements are assembled. Preferably, the flexible blade element (2) represents between 80% and 95% of the total surface area of the blade.

Figure 2:
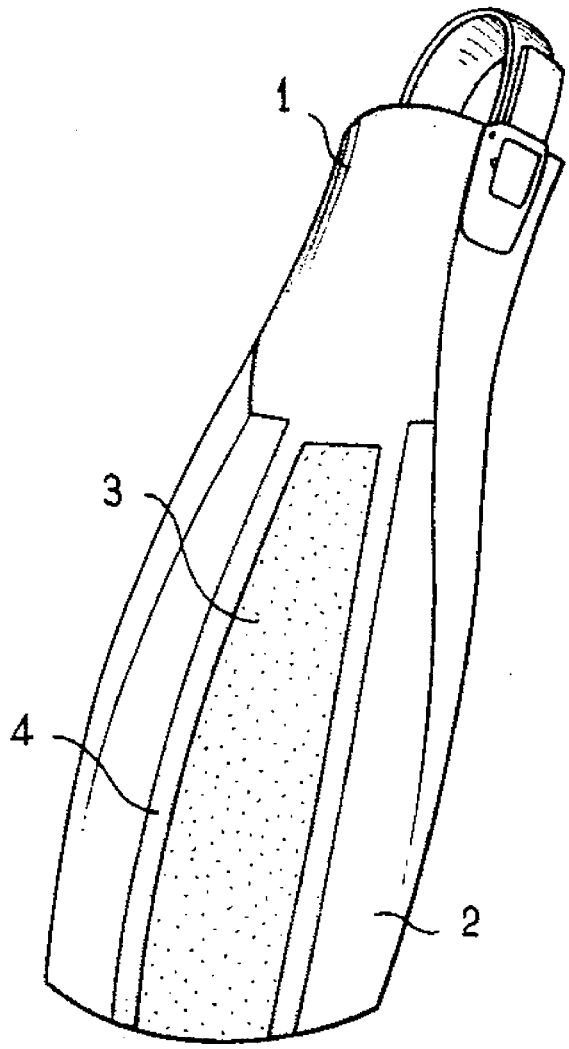
FIG. 2 is a perspective view of the present invention incorporating an adjustable shoe portion.

FIG. 2 represents an adjustable fin, the blade of which is constituted, in its central part, by a stiffening blade element (3) which is flanked by two flexible blade elements (2) which are rendered integral by the overmolding of the bonding material (4).

The fact that the shoe is adjustable or is of the snug-fitting type does not appear as an essential characteristic of the fins according to the present invention. Thus, the blade shown in FIG. 1 may be fitted to the adjustable shoe of FIG. 2, while the blade shown in FIG. 2 may also be fitted to the shoe of FIG. 1.

Figure 3:
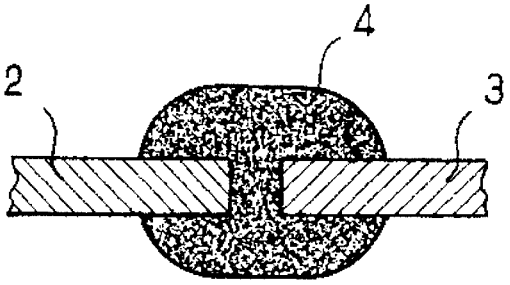
FIG. 3 is sectional view of the first embodiment of the attachment assembly of the present invention.

FIG. 3 represents a sectional view of the assembly of a flexible blade element (2) and a stiffening blade element (3), having substantially equal thicknesses, arranged side by side and rendered integral by the overmolding of the bonding material (4).

Figure 4:
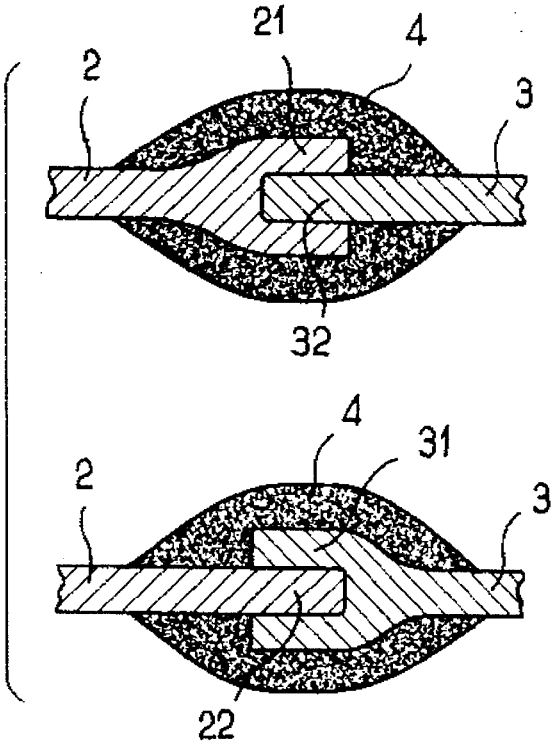
FIG. 4 is sectional view of the second embodiment of the attachment assembly of the present invention.

FIG. 4 represents a sectional view of the assembly of a flexible blade element (2) and a stiffening blade element (3) having substantially equal thicknesses, embedded in each other by an assembly of the mortise-and-tenon type and are rendered integral by overmolding of the bonding material (4).

The adjacent edge of one of the elements forms a mortise (21, 31) into which the adjacent edge of the other element, forming a tenon (22, 32), is fitted.

Figure 5:
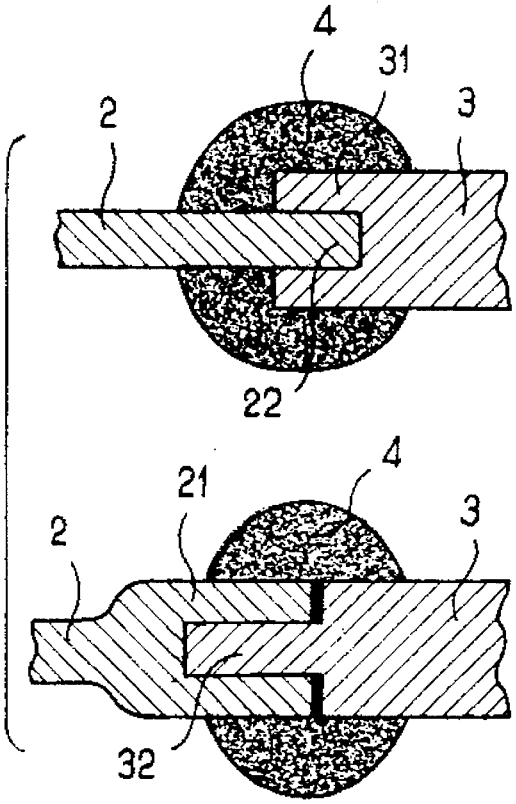
FIG. 5 is sectional view of the third embodiment of the attachment assembly of the present invention.

FIG. 5 represents a sectional view of the assembly of a flexible blade element (2) with a thicker stiffening blade element (3), fitted into each other and rendered integral by the overmolding of the bonding material (4). In the first case, a mortise (31) is formed in the adjacent edge of the thicker element into which the other element, forming a tenon (22), is fitted. Another solution consists in prolonging the adjacent edge of the thicker element by a projection of smaller thickness, forming a tenon (32) which is fitted into a mortise (21) formed in the adjacent edge of the thinner element.

In this case, as for the assembly means shown in FIG. 4, the adjacent edge forming a mortise comprises an enlarged region in which a groove is made.

Figure 6:
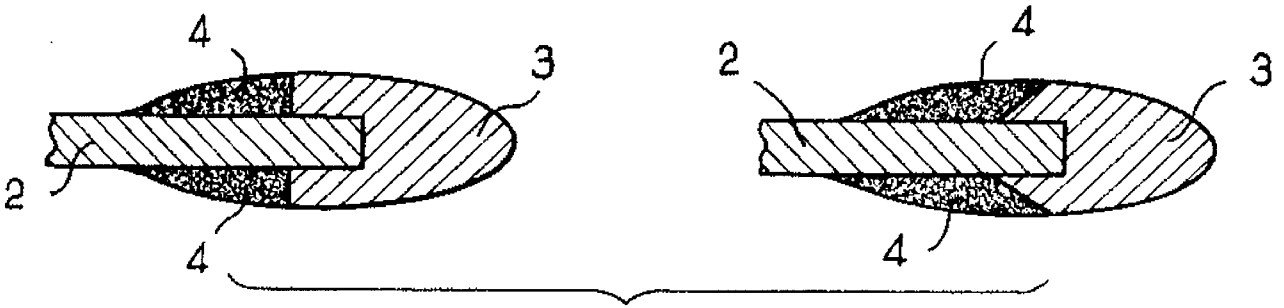
FIG. 6 is sectional view of the fourth embodiment of the attachment assembly of the present invention.

FIG. 6 represents a sectional view of the assembly of a flexible blade element (2), forming a tenon with a thicker stiffening blade element (3) forming a mortise suitable for the blade shown in FIG. 1. The ratio between the thickness of the stiffening blade element (3) and that of the flexible blade element (2) lies between 1.5 and 3.5, preferably lying between 2 and 2.5. The bonding material (4) partially covers the flexible blade element (2) in the proximity of the adjacent edge and is contained in the prolongation of the thicker stiffening blade element (3).

Figure 7:
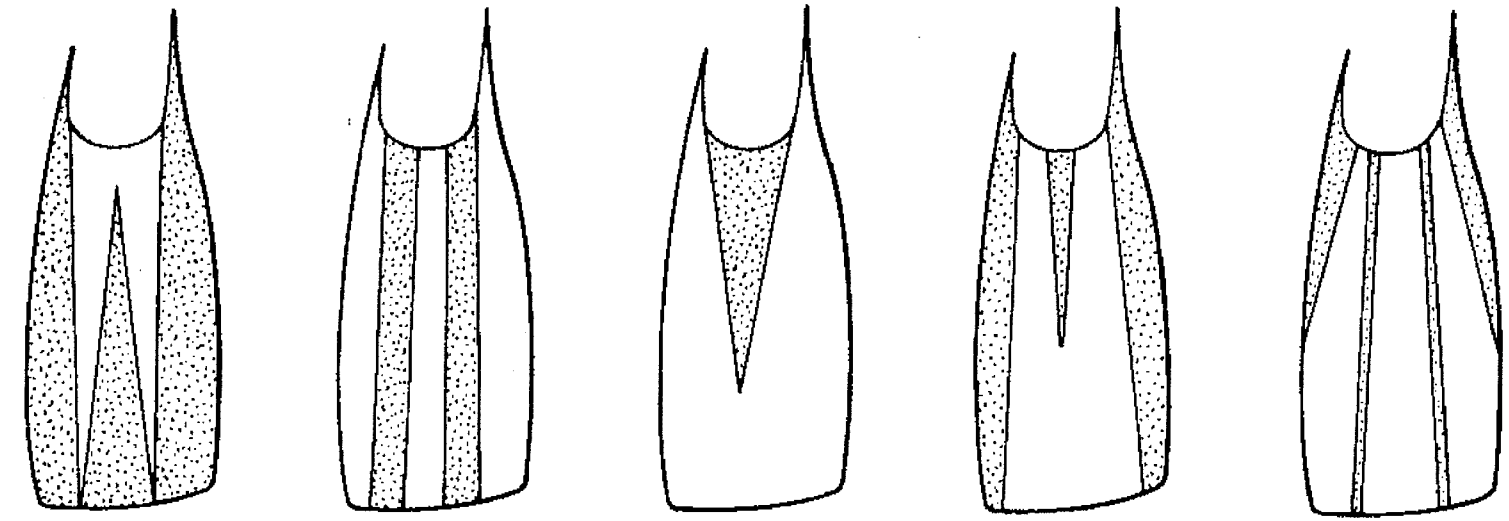
FIG. 7 is a top view illustrating various combination embodiments of the present invention.

For its part, FIG. 7 represents, diagrammatically, various patterns of fins according to the invention, for which patterns the hatched parts constitute stiffening blade elements. These arrangements meet both esthetic and performance criteria, the esthetic selection in no way bringing about the detriment of the technical characteristics of the fin.

The fins according to the invention, represented by FIGS. 1, 2 and 6 are suitable equally well for the user's left foot as for his right foot. The blade elements are therefore all arranged symmetrically with respect to a longitudinal mid-plane perpendicular to the blade plane. However, it will be possible to envisage unsymmetrical fins intended specifically for the swimmer's right foot or for his left foot, the blade elements and the shoe then being arranged appropriately so that each fin, left or right, is the mirror image of the other.

Although the above figures refer to triple-material fins, it is also possible to envisage adding a fourth material such as, for example, a reinforcing rod, such as a rod made of glass or carbon fiber arranged between the flexible blade element (2) and the stiffening blade element (3).

This addition enables, in particular, the performance of fins according to the invention to be enhanced, thus enabling swimming fins of very high efficiency to be produced.

Finally, the present invention relates to a method of manufacturing the composite fins described hereinabove.

The method according to the invention consists in assembling the blade elements (3) edge to edge so as to form a fin blade, then in overmolding, simultaneously or successively, the bonding material (4) over the adjacent edges of the blade elements (2, 3) and the shoe (1).

Preferentially, the bonding material (4) and the shoe (1) are molded simultaneously.

Other characteristics of the method according to the invention and of the fins will appear upon reading the examples hereinbelow.

EXAMPLE 1

Manufacture of a compatible EVA/polypropylene/elastomer triple-material fin.

The flexible blade elements made of EVA and the stiffening blade elements made of polypropylene are molded separately.

Next, the previously obtained blade elements are arranged edge to edge into a desired pattern, shown in FIG. 1, and then the elastomer bonding element and the shoe are overmolded in the same step.

EXAMPLE 2

Manufacture of a compatible polypropylene/polypropylene/elastomer triple-material fin The same method as described in Example 1 is employed.

The fin obtained will be thinner since the flexible blade element made of polypropylene is more resilient.

However, the employment of this polymer material renders the color combinations less easy and its tactile aspect will be less appealing than for the EVA-based fins.

EXAMPLE 3

Characteristics of the fins according to the invention.

The model of the fin according to the invention is an adjustable model in Medium size, that is to say the most sold central size, obtained according to the method described in Example 1.

This fin is compared with an existing adjustable Beuchat Medium fin which, from a weight/performance/-length standpoint, lies within the average of the equivalent fins on the market: this gives the following table for one fin foot:

| | Beuchat Medium Fin | | | Example 1 | | |
|---|---|---|---|---|---|---|
| | Weight | Molding Time | Total Length | Weight | Molding Time | Total Length |
| Blade | 540 g | 1' 30" | 565 cm | 380 g | 30" | 625 cm |
| Shoe | 300 g | 1' 10" | | 350 g | 1' 10" | |
| Stiffener | | | | 2 × 30 g | | |
| TOTAL | 840 g | 2' 40" | | 790 g | 1' 40" | |

It is therefore noticed that, for the fin according to the invention, an increase in the length of the order of 10% (6 cm), therefore of surface area, there is a weight saving of approximately 6% (50 g) and a production time saving of more than 35% (1 minute).

If a comparison is made, according to the ASTM D 790 standards (at 23° C.), of the flexural modulus of elasticity of material currently used for the (EVA) blade, approximately 51, and, with vinyl added in order to increase the shininess, dropping to approximately 45/48, it is found that, with the fin according to the invention, a rib element 3 times less thick is needed than with the commercialized Beuchat Medium fin.

What is more, the fin according to the invention will be approximately 7.5 cm longer, which means a greater surface area for propulsion, and an increase in resilience conferred by the polypropylene of the stiffener will be better than that of the EVA of the conventional blade.

I claim:

1. A swimming fin comprising a shoe prolonged by a blade, wherein the blade is constituted by the assembly of at least one flexible blade element and at least one stiffening blade element which are arranged edge to edge and rendered integral by the overmolding of an appropriate bonding material over the adjacent edges, wherein the blade elements are assembled by their longitudinal edges, which are oriented substantially in the direction of the length of the fin, wherein the bonding material consisting of a material separate from the flexible blade element and the stiffening blade element to provide a triple-material swimming fin.

2. The swimming fin as claimed in claim 1, wherein the blade elements are arranged side by side.

3. The swimming fin as claimed in claim 1, wherein the blade elements are fitted into each other.

4. The swimming fin as claimed in claim 3, wherein the blade elements are fitted by an assembly of the mortise-and-tenon type.

5. The swimming fin as claimed in claim 4, wherein the adjacent edge forming the mortise comprises an enlarged region in which a groove is made.

6. The swimming fin as claimed in claim 1, wherein the flexible blade element is made of EVA.

7. The swimming fin as claimed in claim 1, wherein the stiffening blade element consists of a thermoplastic elastomer material.

8. The swimming fin as claimed in claim 1, wherein the appropriate bonding material is a thermoplastic material.

9. The swimming fin as claimed in claim 1, wherein the flexible blade element is made of EVA, with vinyl added, the stiffening blade element is made of polypropylene and the bonding material is a polypropylene-based thermoplastic material.

10. The swimming fin as claimed in claim 1, wherein the blade elements are polypropylene-based.

11. The swimming fin as claimed in claim 1, wherein the bonding material and shoe consist of the same material.

12. The swimming fin as claimed in claim 1, wherein the blade elements are arranged symmetrically with respect to a longitudinal mid-plane perpendicular to the blade plane.

13. The swimming fin as claimed in claim 12, wherein the blade comprises a flexible blade element flanked by two stiffening blade elements.

14. The swimming fin as claimed in claim 13, wherein the flexible blade element represents more than 60% of the total surface area of blade.

15. The swimming fin as claimed in claim 12, wherein the blade comprises a stiffening blade element flanked by two flexible blade elements.

16. The swimming fin as claimed in claim 1, wherein the blade elements and the shoe are arranged appropriately, so that each fin, left or right, is the mirror image of the other.

17. The swimming fin of claim 1 wherein the flexible blade element and the stiffening blade element have different thickness.

18. The swimming fin of claim 17, wherein the ratio between the thickness of the stiffening blade element and that of the flexible blade element lies between 1.5 and 3.5.

19. The swimming fin as claimed in claim 18, wherein the bonding material partially covers the flexible blade element in a proximity of the adjacent edge and is contained in the prolongation of the stiffening blade element.

* * * * *